United States Patent [19]

Lewis

[11] 3,972,162

[45] Aug. 3, 1976

[54] BUILDING MODULES

[75] Inventor: Thomas Maldwyn Lewis, Knights Enham, near Andover, England

[73] Assignee: Vagabond Films Establishment, Vaduz, Liechtenstein

[22] Filed: Oct. 20, 1975

[21] Appl. No.: 624,222

[30] Foreign Application Priority Data

Oct. 23, 1974 United Kingdom..... 45888/74

[52] U.S. Cl...... 52/69; 52/185; 52/79

[51] Int. Cl.[2]..... E04B 1/344; E04H 1/12

[58] Field of Search..... 52/79, 64, 67–69, 52/65, 66, 36, 70, 185

[56] References Cited

UNITED STATES PATENTS

| | | | |
|---|---|---|---|
| 1,416,146 | 5/1922 | White | 52/69 |
| 1,474,864 | 11/1923 | Vogt et al. | 52/64 |
| 2,717,429 | 9/1955 | Nead | 52/70 |

FOREIGN PATENTS OR APPLICATIONS

| | | | |
|---|---|---|---|
| 399,544 | 10/1933 | United Kingdom | 52/70 |
| 443,024 | 2/1936 | United Kingdom | 52/36 |

*Primary Examiner*—James L. Ridgill, Jr.
*Attorney, Agent, or Firm*—Reed Smith Shaw & McClay

[57] ABSTRACT

A domestic building room module is provided which converts a living room into a smaller room plus another room which may be a bedroom, comprising fixed wall structures enclosing a lower floor and an upper floor, the said upper floor being spaced from the lower floor at a height not exceeding one-third of the height of the wall structures, the said upper floor containing a portion rotatable about a horizontal axis to form in a horizontal position an upper floor portion of the module and in a vertical position to form a wall dividing the room and whereby in the vertical position a portion of the lower floor is exposed, and drive means to effect the said rotation.

6 Claims, 8 Drawing Figures

BUILDING MODULES

Figure 1A:
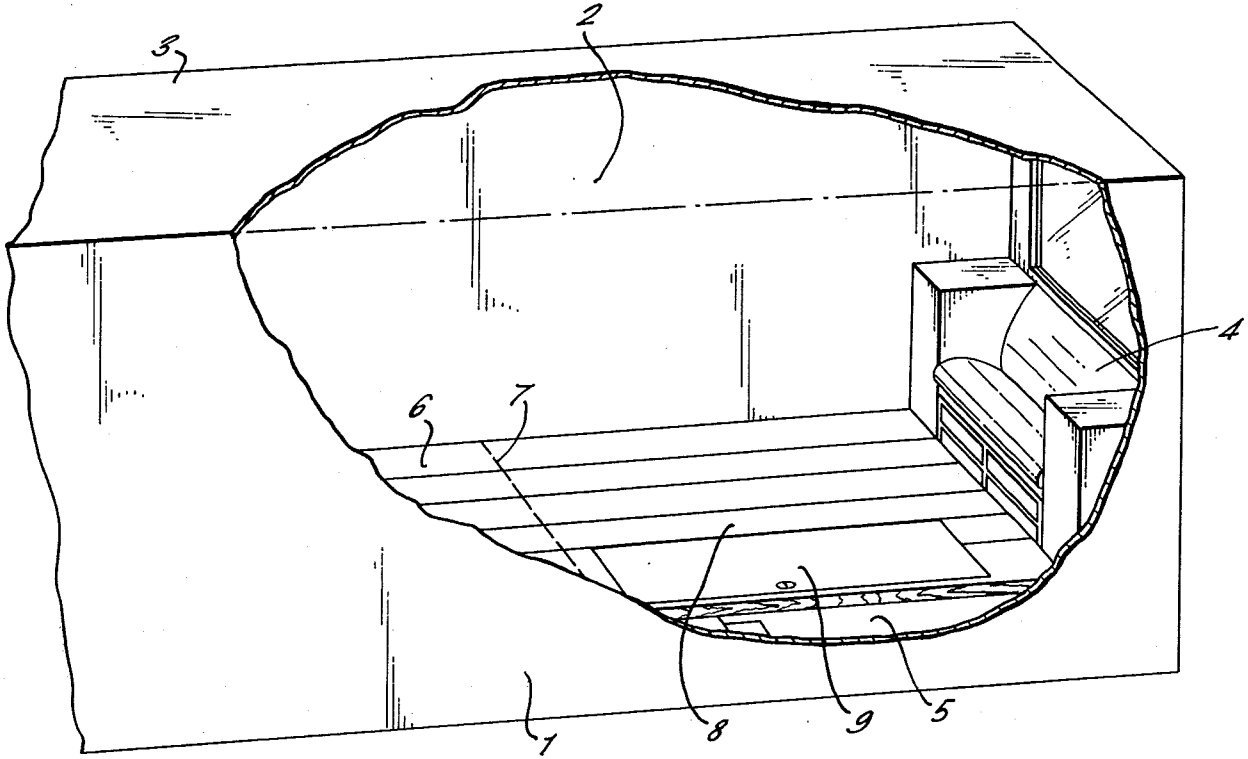

This invention relates to prefabricated domestic building modules and particularly relates to room modules which comprise two superposed floor levels, wherein a portion of the upper floor level may be converted to expose a portion of the lower floor, and to provide a dividing wall of the room.

There is a continuing need for prefabricated room modules whereby a dwellinghouse may rapidly and cheaply be constructed therefrom. Previously-proposed room modules are generally designed to provide separate day-living accommodation and bedroom accommodation as desired. However the prevailing need for low cost housing requires the use of as few modules as possible and the present invention is directed to a module which may be used both as a living room and which also provides a space for provision of a bedroom and its furniture, wherein the bedroom is hidden from view when not in use.

The invention provides a room module comprising fixed wall structures enclosing a lower floor and an upper floor, the said upper floor being spaced from the lower floor at a height not exceeding one-third of the height of the wall structures, the said upper floor containing a portion rotatable about a horizontal axis to form in a horizontal position an upper floor portion of the module and in a vertical position to form a wall dividing the room module, whereby in the vertical position a portion of the said lower floor is exposed; and drive means to effect the said rotation of the said portion.

The rotation of the rotatable upper floor portion may be effected by a mechanically operated thrust-screw or by a quadrant movable by rope or by toothed engagement with a gear element, or may be effected by pneumatic or hydraulic means. Rotation of the said upper floor portion may be assisted by counter-weighting mechanisms, e.g. by a counter weight or spring mechanism.

The said drive means may be a manually-operable drive means, or a power-operated drive means, e.g. powered by an electric motor. Preferably power-drive means is adapted to be changed from a powered drive to a manual drive as desired.

The area of the lower floor exposed by rotation of the said upper floor portion, thereby effectively forming a well, preferably contains a built-in step unit leading from the upper floor to the lower floor, and may be used to contain a bed and/or may be used as storage space. The rotatable portion of the upper floor is so dimensioned that when it is rotated to a vertical position it forms an ancillary dividing wall unit.

The room modules may contain on the said upper and/or lower floor built-in units, e.g. kitchen units, bathroom units and/or water closet units separated by prefabricated wall portions. Built-in cupboards may be provided and if desired a ceiling possibly with associated roof portion.

The prefabricated room modules also contain access means e.g. door spaces, as required.

In its simplest form a single module according to the invention itself provides a complete dwelling unit. If desired further modules which may or may not be according to the invention, may be added as required. The provision of the rotatable floor portion in the upper floor portion of additional room modules results in complete freedom of choice for the occupant of the dwelling unit comprising a plurality of such modules for the use of the lower floor of each module. Thus the said lower floor areas in one or more integrated modules may be provided with a bed, the other lower floor areas possibly being used as storage space, or for the accommodation of heating units or other service units for dwellinghouses. Furthermore, the space below the upper floors may accommodate electrical conduits, plumbing or soil pipes, which may be prefabricated into the room module.

Figure 1B:
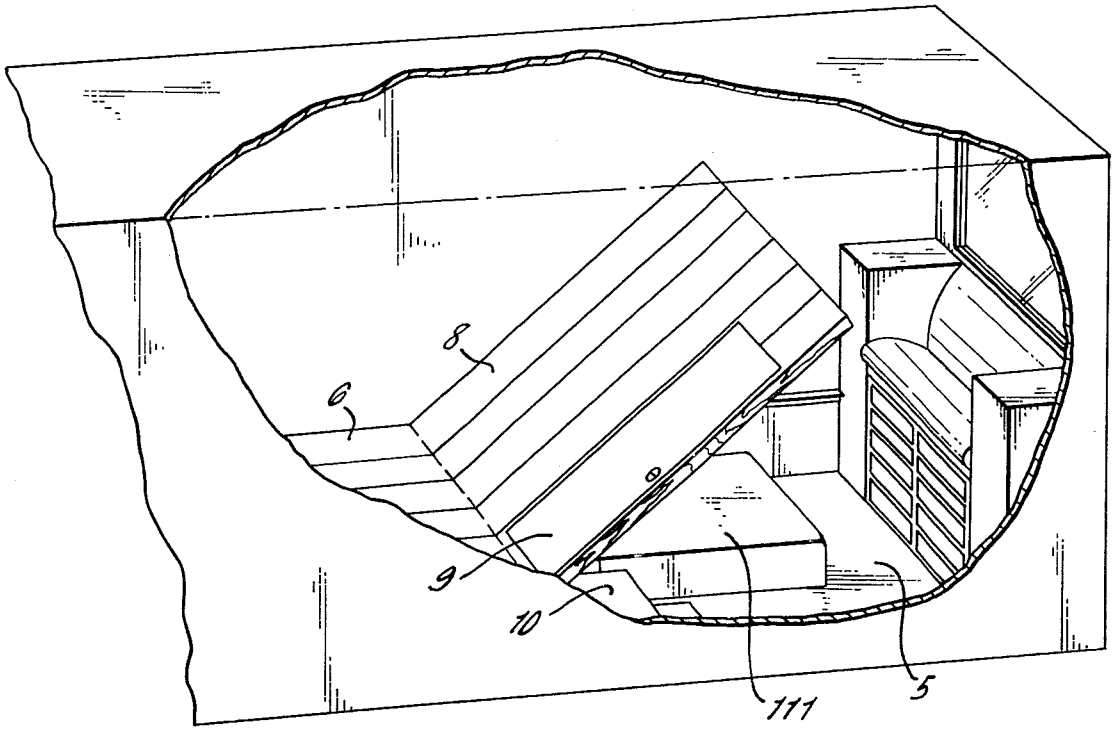
Figure 1C:
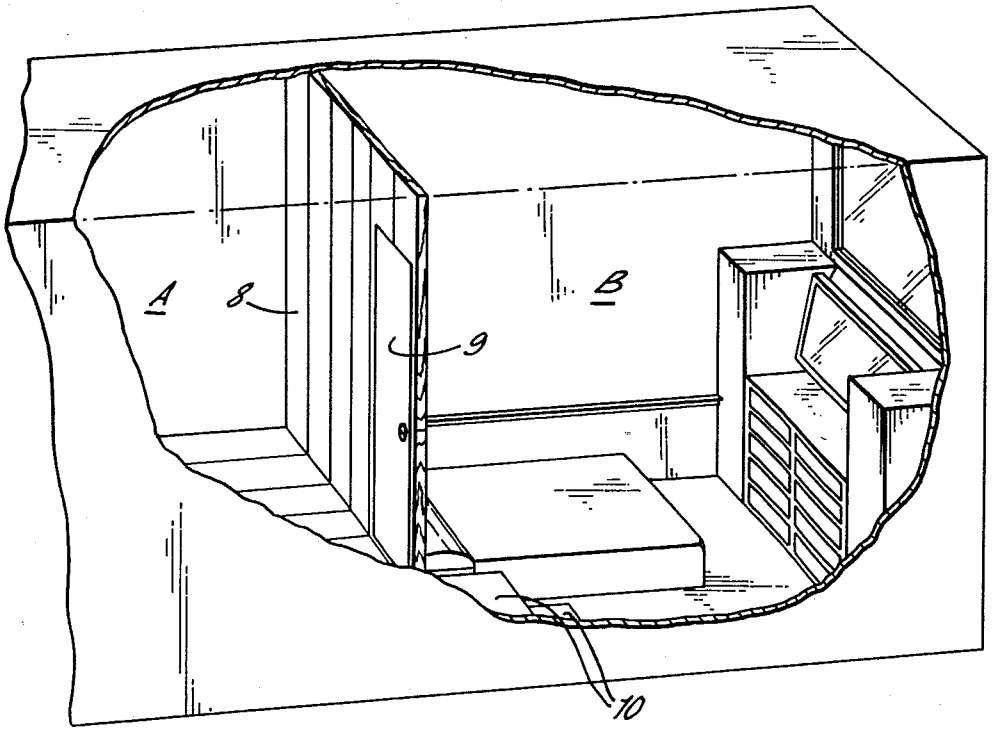

The invention is hereinafter more particularly described and illustrated in the accompanying drawings, of which FIGS. 1*a*, 1*b* and 1*c* represent a cut-away perspective view of one embodiment of a room module according to the invention wherein FIG. 1*a* shows the room module with the rotatable upper floor portion in a horizontal position to form part of the upper floor of the room, FIG. 1*b* shows the room module with the said rotatable portion in a partly raised position, and FIG. 1*c* shows the room module with the said rotatable portion in a vertical position forming a dividing wall.

Figure 2A:
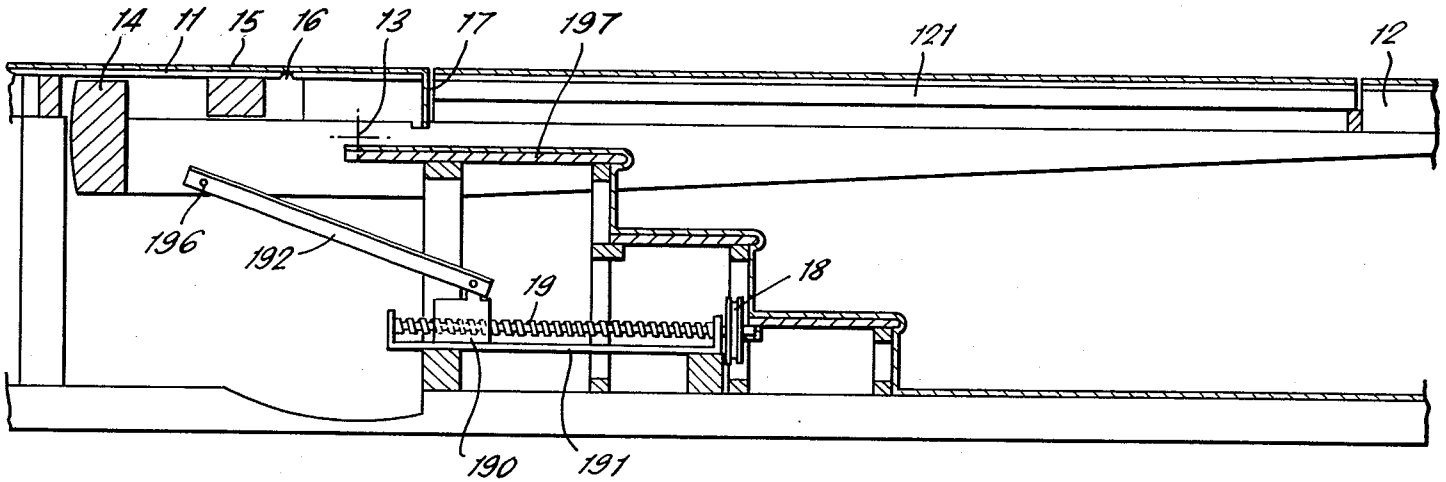
Figure 26:
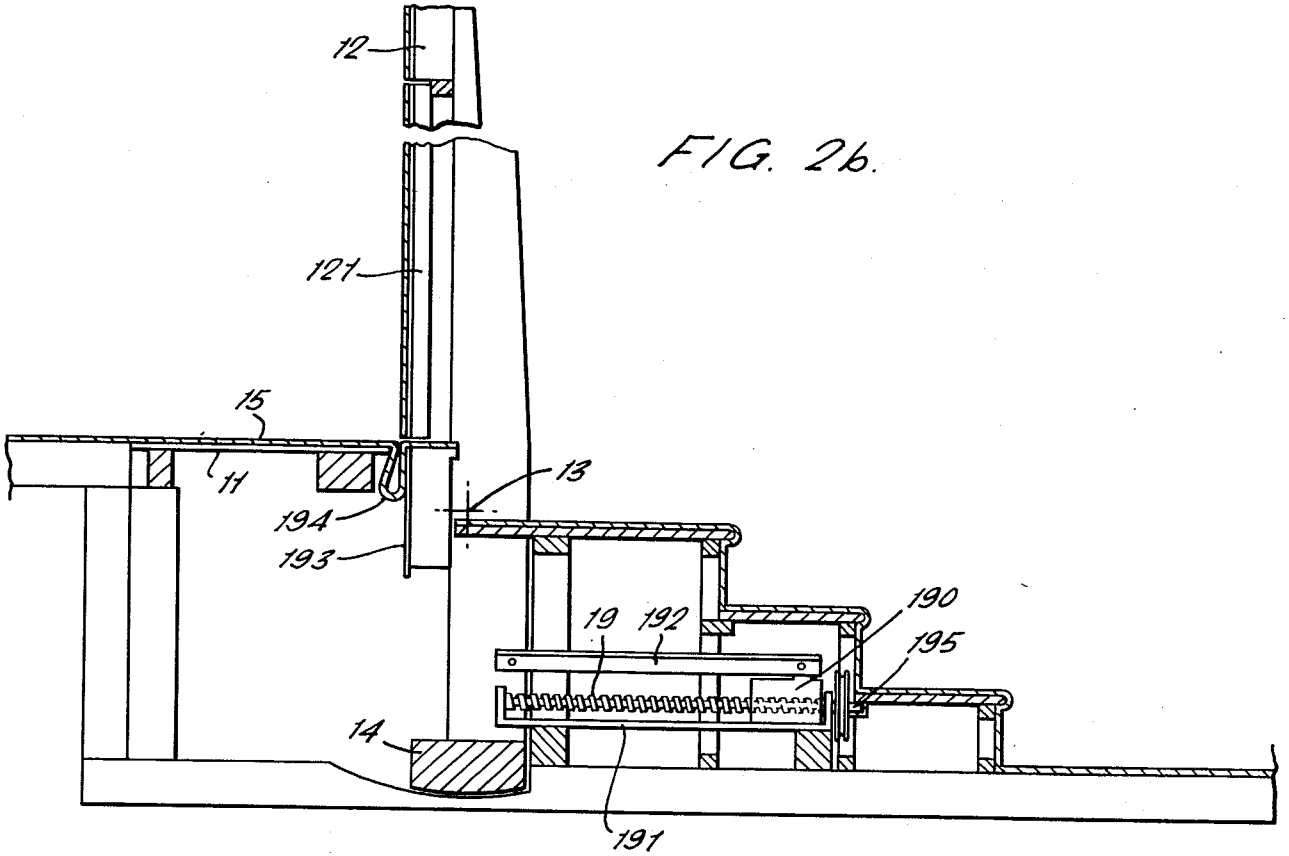

FIG. 2*a* shows a partial cross-sectional view in elevation of the room module as shown in FIG. 1*a;*

FIG. 2*b* shows a partial cross-sectional view in elevation of the room module as shown in FIG. 1*c;*

Figure 3A:
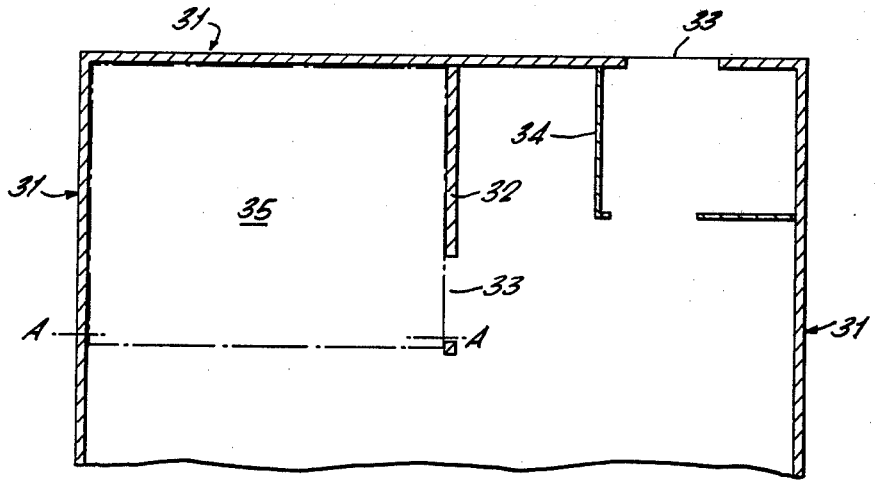
Figure 3B:
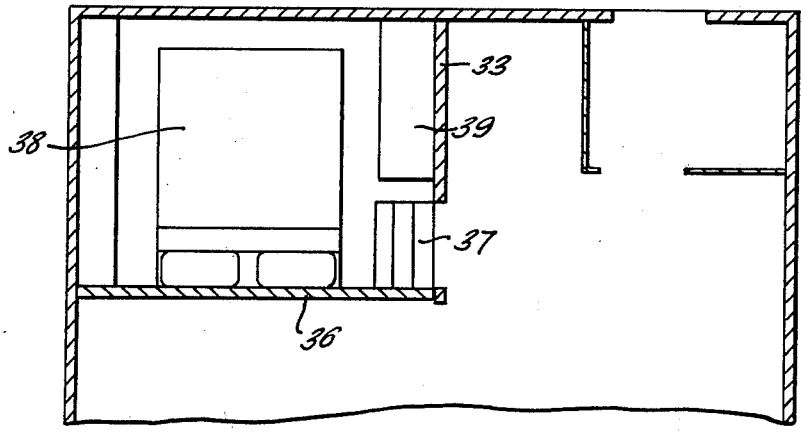
Figure 4:
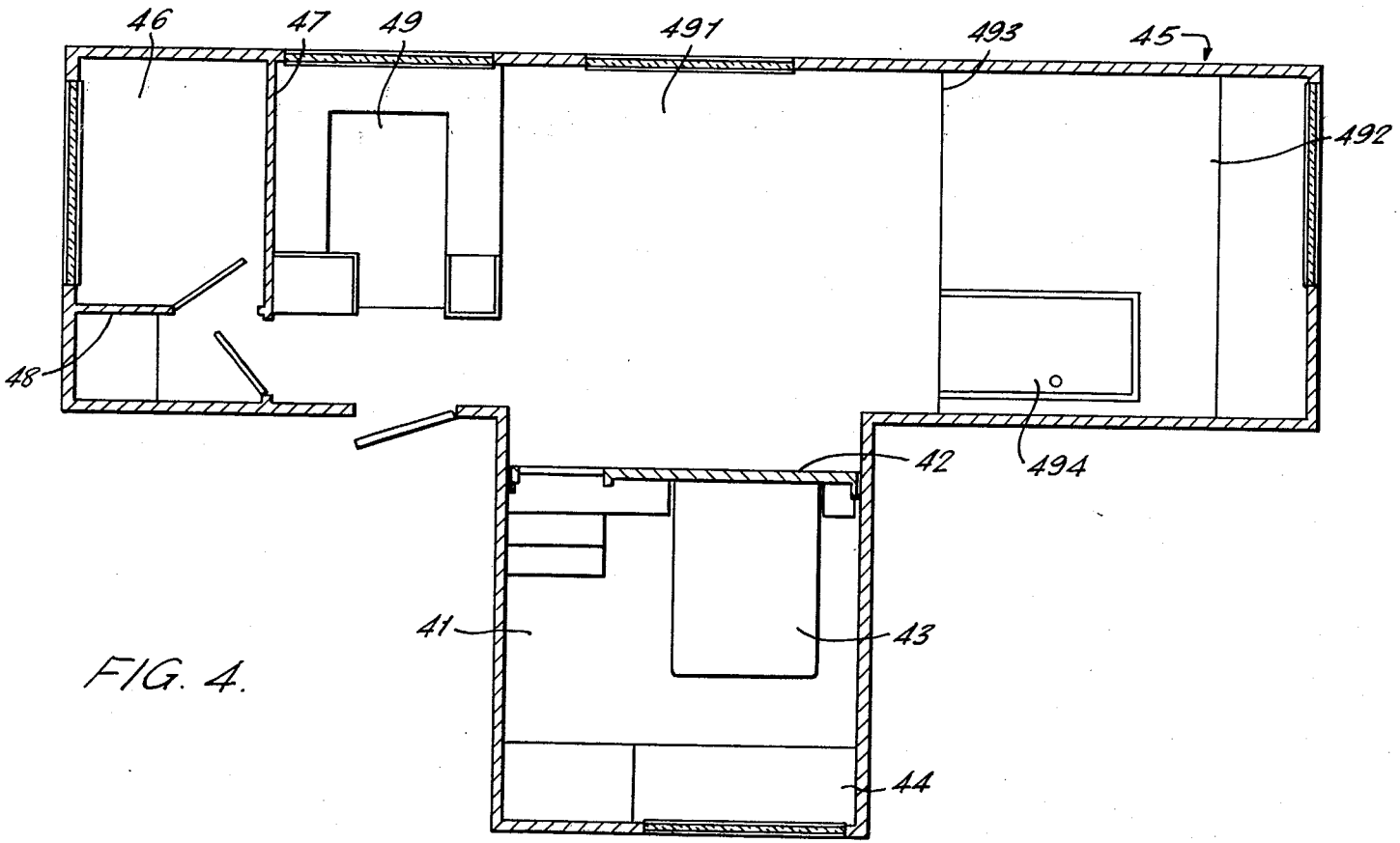

FIG. 3*a* represents a plan view of the upper floor of the room module according to an alternative arrangement of the invention;

FIG. 3*b* is a plan view of the floor of FIG. 3*a* showing the well portion exposed by rotation of the floor portion to a vertical position;

FIG. 4 represents a plan view of a composite prefabricated living unit according to the invention.

Referring to FIG. 1*a*, the room module is shown represented as a living room comprising walls 1, 2, a ceiling 3 and containing optional built-in furniture units, one of which by way of example is a settee 4.

The module contains a lower floor portion 5 and an upper floor portion 6. A rotatable portion 8 of the upper floor is rotatable on bearings spanning the total width of the room between walls 1 and 2 parallel and adjacent to line 7 to provide a dividing wall which in the embodiment illustrated contains a door 9 shown in closed position.

Referring to FIG. 1*b*, the rotatable portion 8 of the upper floor is shown in a partly-raised position, revealing the said lower floor 5, and a built-in step unit 10 leading from the upper floor to the said lower floor 5. In the embodiment illustrated a bed 111 is provided on the lower floor 5, and in FIG. 1*c* by way of example the settee 4 is shown converted into a dressing table mirror having an extension to the lower floor containing drawers.

Referring to FIG. 1*c*, the rotatable portion 8 of the upper floor is shown in vertical position to effectively divide the original living room into portion A and portion B comprising a bedroom. Occupants of room portion A may enter the bedroom by opening the door 9 and descending the step unit 10.

A catch means (not shown) is normally applied to door 9 to maintain it in the closed position when in a horizontal or partly raised position. Preferably the catch means is so arranged that power means for raising the floor portion 8 may not operate until the said catch means has fixedly closed the door.

In the embodiment illustrated the rotatable floor portion 8 is shown as extending completely across the original room. Alternative constructions may however be applied wherein the portion 8 may extend only a portion of the way across the room and a permanent dividing wall provided forming a corridor or another room unit alongside the length of the rotatable floor portion 8. In such an arrangement the door 9 may be inserted in the said permanent dividing wall instead of the rotatable portion 8.

The said portion 8 when raised into a vertical position to effect a dividing wall of the room module, effectively meets the ceiling. In practice however an architrave portion may be fixedly attached to the ceiling of the room module to reach down to the top of the rotatable portion when in a vertical position.

A particular example of the drive means to effect rotation of the movable upper floor portion of room modules according to the invention is hereinafter described and illustrated in FIGS. 2*a* and 2*b* of the accompanying drawings, which represent an elevational cross section of a portion of the upper and lower floors of a room module according to the invention the said section being taken through a door and step unit, FIG. 2*a* showing the rotatable floor portion in a horizontal position and FIG. 2*b* showing the said floor portion in a vertical position.

Referring to FIG 2*a*, the fixed upper floor 11 contains a rotatable portion 12, rotatable about a horizontal pivot axis 13. The said rotatable portion 12 contains a door 121, leading to a step unit 197. A counterweight 14 is provided to assist in the rotation of the said rotatable portion.

Carpeting or other surface covering 15 is provided on the fixed upper floor portion extending over a gap 16 between the fixed floor portion 11 and the axis end of the rotatable portion 12, and which, in the embodiment illustrated, is tucked into a flat door-sill 17 of the rotatable portion 12. The whole of the moving floor except the doorway, is similarly covered by surface covering.

Rotational movement of the rotatable portion 12 is effected by an electric motor (not shown) driving pulley 18 attached to worm screw 19 whereby block 190 threaded to engage the said worm screw 19 travels horizontally in guide means 191, such lateral movement being transmitted into rotational movement of the rotatable portion 12 by lever-arm 192 connecting the said movable block 190 to the counter-weighted end of the rotatable upper floor portion 12 by connecting pin 196. If it is desired, or becomes necessary, to disconnect the driving means from the rotatable upper floor portion 12 whereby it may be rotated manually the said lever-arm 192 may be detached from the counterweighted end of rotatable floor 12 by removal of the said connecting pin 196, access for such removal being provided by removal of a removable portion of fixed floor 11 (not shown).

FIG. 2*b* shows the rotatable upper floor portion 12 in a vertical position, achieved by movement of block 190 to an extreme end position in the guide means 191.

By virtue of the fact that the said floor covering 15 remains unattached to the end portion 193 of rotatable floor portion 12, the achievement of a vertical position of the portion 12 results in the said floor covering becoming folded into fold 194 extending below the surface of the fixed floor 11. Restoration of the portion 12 to a horizontal position enables the folded portion 194 to become taken up to cover the said gap 16 (FIG. 2*a*) in a taut manner.

In the embodiment illustrated the driving means for effecting the said rotation and comprising the pulley 18, worm screw 19, block 190 and lever 192, are disposed under stair unit 194. The electric motor prime mover (not shown) may be disconnected from pulley 18, and the rotation of the floor portion 12 effected by mounting a handle on the end 195 of the spindle carrying the worm screw 19. Alternatively if the connecting pin 196 by which the lever 192 is attached to the pivot end of the rotatable floor portion is removed, then the counterbalanced floor 12 may be moved easily up and down by hand.

If desired, the drive means illustrated in the embodiment of FIGS. 2*a* and 2*b* may be replaced by a modified mechanical arrangement, e.g. wherein the lever member 192 is replaced by a toothed arc mamber engaging with block 190 or worm screw 19, or by a flanged arc member actuated by cable means operable by a prime mover. Alternatively such mechanical arrangements may be replaced by pneumatically or hydraulically operable mechanisms well-known to the art for effecting rotational movement of a pivoted member.

In the embodiment heretofore illustrated the fixed walls 1, 2 may be made of any material conventionally used in prefabricated building, for instance slabs of sintered clay bonded with cement, or framed plastics or wood sheets. The rotatable floor portion may be fabricated for instance as a stressed skin of laminated wood or plastics, e.g. P.V.C. on a light weight frame.

The ceiling portion may be provided with a roof, e.g. a sloping or pitched roof, or the fixed wall portions may be adapted to receive a further room module on their upper ends, whereby a multi-storey composite dwelling may be obtained.

The room module incorporating the features according to the invention may be provided with alternative arrangements over that illustrated in the aforesaid FIGS. 1*a* to 1*c*. An embodiment of such alternative arrangements is shown in FIGS. 3*a* and 3*b* which is a plan view of a room module according to the invention, wherein FIG. 3*a* shows the rotatable upper floor portion in horizontal position and FIG. 3*b* shows the well exposed by rotation of the said floor portion to a vertical position.

Referring to FIGS. 3*a* and 3*b*, the room module comprises fixed external wall portions 31, a fixed inner wall portion 32, door spaces 33, a prefabricated vestibule 34 and a portion 35 of the upper floor level rotatable about an axis A—A.

Rotation of the floor portion 35 about the axis A—A of FIG. 3*a* reveals a portion of the lower floor which in the embodiment illustrated includes a built-in step unit 37, a bed 38 and a wardrobe 39. When the said floor portion 35 is in a vertical position, it forms a dividing wall of the room module, shutting it off from the remainder of the dwelling unit.

If desired a room module according to the invention may be associated with another similar room module and/or conventional room modules, i.e. prefabricated room units which may contain prefabricated fixed service units.

An example of such a composite prefabricated living unit is hereinafter described and illustrated in plan view in FIG. 4 of the accompanying drawings.

In FIG. 4 a room module 41 according to the invention is shown with dividing wall 42 in vertical position, the said room module 41 containing a bed 43 and prefabricated units as hereinbefore described.

The said room module 41 forms an integral structure with a further room module according to the invention disposed at right angles to the room module 41 and comprising a bathroom 46 provided with fixed walls 47 and 48, a kitchen section 49 provided with prefabricated kitchen units, a living area 491 being provided with a rotatable upper floor portion 492 mounted to rotate about the line 493, and provided with a door 494. Beneath the rotatable portion 492 there may be provided further bedroom accommodation or accommodation for a quiet room.

Thus by such an arrangement when the rotatable wall portion 42 of module 41 is moved to a horizontal position, a very large living/dining/cooking area is provided, and when the rotatable wall portions 42 and 492 are moved to a vertical position, the aforesaid open space is transformed into a three-room space, giving two bedrooms with complete privacy.

What is claimed is:

1. A domestic room module consisting essentially of a. fixed wall structures enclosing a lower floor and an upper floor, the said upper floor being spaced from the lower floor at a height not exceeding one-third of the height of the wall structures, b. a portion of the said upper floor rotatable about a horizontal axis to form in a horizontal position an upper floor portion of the module and in a vertical position to form a wall dividing the room and whereby in the vertical position a portion of the lower floor is exposed, and c. drive means to effect the said rotation of the said portion of the said rotatable upper floor portion.

2. A room module according to claim 1, wherein the said rotatable portion is counter balanced by a weight.

3. A room module according to claim 1, wherein the said drive means are detachable from the said rotatable upper floor portion.

4. A room module according to claim 1, wherein the said rotatable portion contains a door.

5. A room module according to claim 1, wherein a step unit is provided extending from the said upper floor to the said lower floor.

6. A room module according to claim 5, wherein the said drive means are located below the said step unit.

* * * * *